US005319992A

United States Patent [19]

Shui-Te

[11] Patent Number: 5,319,992

[45] Date of Patent: Jun. 14, 1994

[54] RAPID LOCKING DEVICE

[76] Inventor: Tsai Shui-Te, P.O. Box 82-144, Taipei, Taiwan

[21] Appl. No.: 46,423

[22] Filed: Apr. 14, 1993

[51] Int. Cl.[5] ..... G05G 1/10; E05C 5/02

[52] U.S. Cl. ..... 74/543; 74/557; 74/527; 74/548; 292/66; 292/336.3; 16/112

[58] Field of Search ..... 74/543, 527, 526, 557, 74/548; 292/66, 336.3, DIG. 31, DIG. 43; 16/257, 259, 254, 112, DIG. 30, DIG. 36

[56] References Cited

U.S. PATENT DOCUMENTS

| | | | |
|---|---|---|---|
| 3,769,853 | 11/1973 | Schluckebier | 74/548 X |
| 3,857,300 | 12/1974 | O'Dell et al. | 74/543 X |
| 4,033,010 | 7/1977 | McCalla | 74/543 X |
| 4,162,805 | 7/1979 | Hirschberger | 74/557 X |
| 4,456,219 | 6/1984 | Scott et al. | 16/DIG. 36 X |
| 4,475,415 | 10/1984 | Yamamoto | 74/543 |
| 4,674,777 | 6/1987 | Guelck | 292/336.3 X |
| 4,702,504 | 10/1987 | Brothers | 74/543 X |
| 4,917,303 | 4/1990 | Maas et al. | 74/527 X |
| 5,072,913 | 12/1991 | Carroll et al. | 16/112 X |

FOREIGN PATENT DOCUMENTS

| | | | |
|---|---|---|---|
| 677474 | 3/1930 | France | 74/543 |
| 958601 | 3/1950 | France | 74/543 |

*Primary Examiner*—Vinh T. Luong
*Attorney, Agent, or Firm*—Alfred Lei

[57] ABSTRACT

A rapid locking device including: a handle formed with a curved portion at one end, two lugs at another end, a first hole between said two lugs, and an opening below the hole; a fixing member with a threaded hole and a second hole; a center rod threadedly engaged with the threaded hole of said fixing member; an axle extending through the lugs of said handle and said fixing member; a spring-loaded pin inserted into the first hole of said handle; and a button disposed within the opening of said handle and connected with a lower end of said spring-loaded pin, whereby the handle may be firmly and quickly kept in a fixed position.

1 Claim, 3 Drawing Sheets

RAPID LOCKING DEVICE

BACKGROUND OF THE INVENTION

1. Description of the Prior Art

It has been found that the prior art rapid locking device is often and easily loosened when subjected to vibration. Hence, various rapid locking devices have been developed to eliminate this defect. However, they are still unsatisfactory in use.

It is, therefore, an object of the present invention to provide an improved locking device which may obviate and mitigate the above-mentioned drawbacks.

SUMMARY OF THE INVENTION

This invention relates to an improved rapid locking device.

It is the primary object of the present invention to provide a rapid locking device which may quickly keep the handle in a fixed position.

It is another object of the present invention to provide a rapid locking device which may release the handle in a short time.

It is still another object of the present invention to provide a rapid locking device which is facile in operation.

It is still another object of the present invention to provide a rapid locking device which is simple in construction.

It is a further object of the present invention to provide a rapid locking device which is inexpensive to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
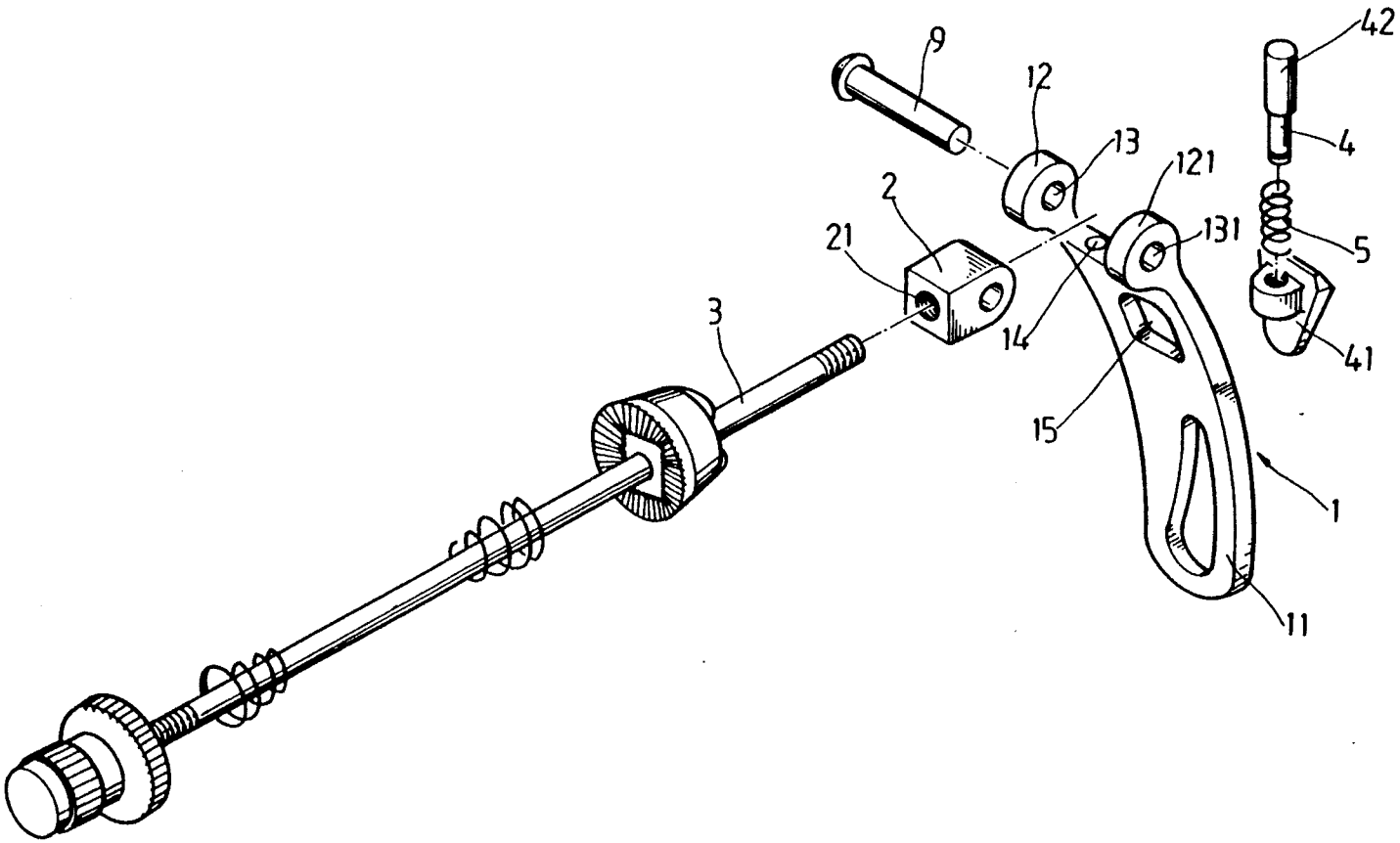
FIG. 1 is an exploded view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
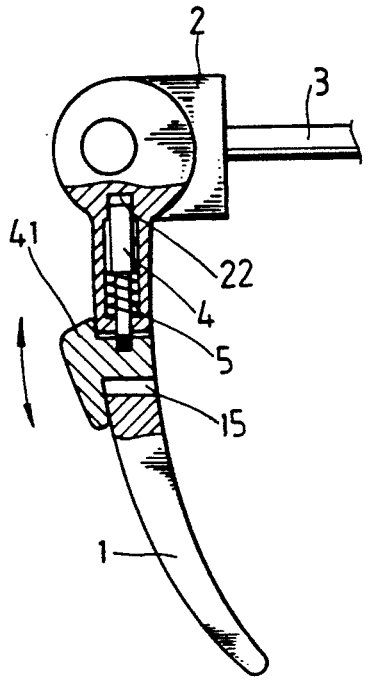
FIG. 2 is a sectional view of the present invention.

With reference to the drawings and in particular to FIGS. 1 and 2 thereof, the rapid locking device according to the present invention comprises a handle 1 formed with a curved portion 11 at one end and two lugs 12 and 121 at another end. The lugs 12 and 121 are provided with holes 13 and 131 which are aligned with each other. Further, the handle 1 is provided with a hole 14 between the two lugs. Below the hole 14, there is an opening 15 in the handle 1. Between the two lugs 12 and 121 there is mounted a fixing member 2 with a threaded hole 21 engaged with a center rod 3. Further, the push member 2 is formed with a hole 22 (see FIG. 2) for engaging with a pin 4. The upper end 4 of the pin 4 is larger than the lower end of the pin 4. An axle 9 extends through the lugs 12 and 121 of the handle 1 and the fixing member 2 to join them together. The pin 4 is enclosed with a spring 5 and inserted into the hole 14 of the handle 1 and threaded engaged with a button 41 disposed within the opening 15 of the handle 1.

Hence, when the handle 1 is turned so that hole 22 of the fixing member 2 is aligned with the pin 4, the spring 5 will force the upper end of the pin 4 to go into the hole 22 of the fixing member 2 thereby keeping the handle 1 in a fixed position. When desired to release the handle 1, it is only necessary to push the button 41 downward as shown in FIG. 2.

Figure 3A:
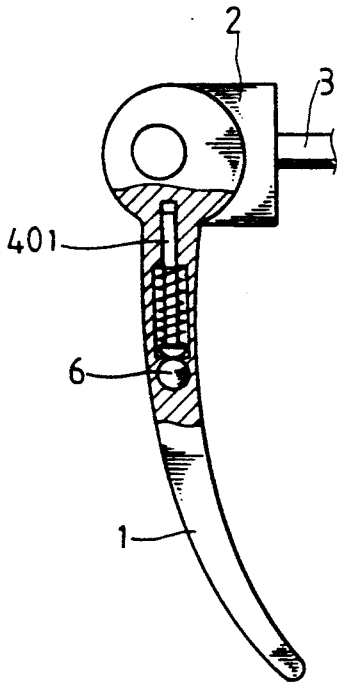
FIGS. 3A and 3B show a second preferred embodiment of the present invention.
Figure 3B:
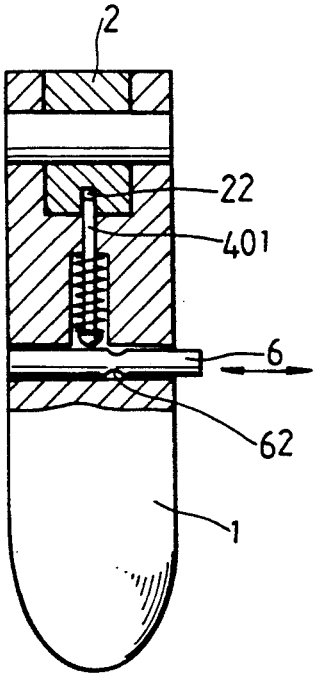

FIGS. 3A and 3B show a second preferred embodiment of the present invention. As may be seen, the pin 401 is provided with a larger portion at the lower end. The button 41 is replaced with a pin 6 with a recess 62 at the intermediate portion. Thus, when the pin 6 is pushed so that the recess 62 is engaged with the larger portion of the pin 401, the handle 1 will be kept in a fixed position, and vice versa.

Figure 4A:
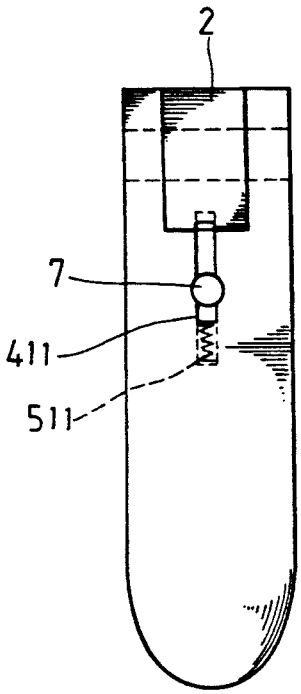
FIGS. 4A and 4B show a third preferred embodiment of the present invention.
Figure 4B:
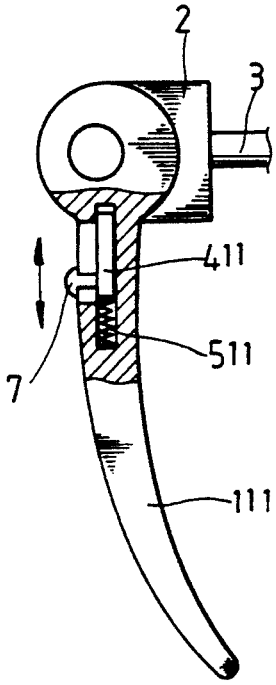
Figure 5:
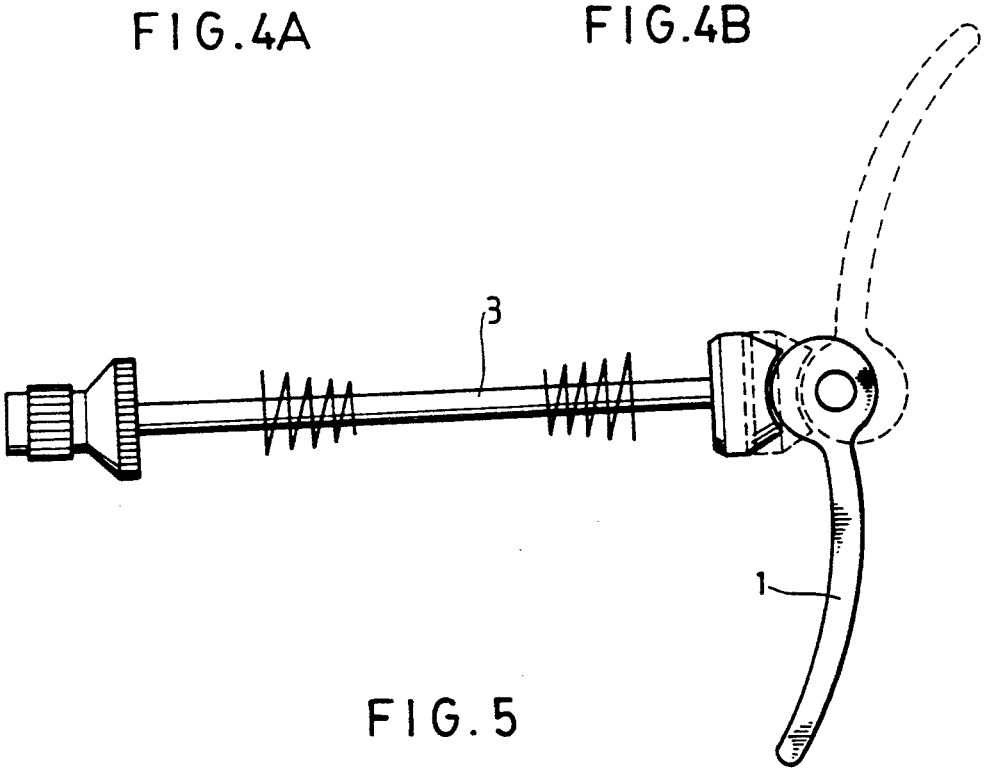
FIG. 5 is a working view of the present invention.

FIGS. 4A and 4B show a third preferred embodiment of the present invention. As shown, the pin 411 is provided with a protuberance 7 extending out of the handle 1, and the spring 511 is disposed in a blind hole of the handle 111. Hence, the handle 111 will be fixed in place when the protuberance 7 of the pin 411 is pushed upward and vice versa.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A rapid locking device comprising:

a handle formed with a curved portion at one end, two lugs at another end, a first hole between said two lugs, and an opening below the hole;

a fixing member with a threaded hole and a second hole;

a center rod threadedly engaged with the threaded hole of said fixing member;

an axle extending through the lugs of said handle and said fixing member;

a spring-loaded pin inserted into the first hole of said handle; and a button disposed within the opening of said handle and connected with a lower end of said spring-loaded pin.

* * * * *